United States Patent [19]

Muller et al.

[11] Patent Number: 4,860,969

[45] Date of Patent: Aug. 29, 1989

[54] AIRBORNE BODY

[75] Inventors: Peter Muller, Nuremberg; Josef Nagler, Rothenbach; Utz-Udo Ahlers, Schnaittach, all of Fed. Rep. of Germany

[73] Assignee: Diehl GmbH & Co., Nuremberg, Fed. Rep. of Germany

[21] Appl. No.: 201,031

[22] Filed: Jun. 1, 1988

[30] Foreign Application Priority Data

Jun. 30, 1987 [DE] Fed. Rep. of Germany ..... 3721512

[51] Int. Cl.[4] ..... F42B 15/027; F42B 13/32

[52] U.S. Cl. ..... 244/3.27; 244/3.28

[58] Field of Search ..... 244/3.27, 3.28, 3.29, 244/3.3

[56] References Cited

U.S. PATENT DOCUMENTS

| | | | |
|---|---|---|---|
| 2,801,587 | 8/1957 | Gould | 244/3.3 |
| 3,098,445 | 7/1963 | Jackson | 244/3.28 |
| 3,174,430 | 3/1965 | Apotheloz | 244/3.28 |
| 4,143,838 | 3/1979 | Holladay | 244/3.28 |
| 4,175,720 | 11/1979 | Craig | 244/3.28 |
| 4,203,569 | 5/1980 | Marks | 244/3.23 |
| 4,728,058 | 3/1988 | Brieseck et al. | 244/3.28 |

FOREIGN PATENT DOCUMENTS

| | | | |
|---|---|---|---|
| 3432614 | 3/1986 | Fed. Rep. of Germany | 244/3.28 |
| 977111 | 12/1964 | United Kingdom | 244/3.28 |

*Primary Examiner*—Deborah L. Kyle
*Assistant Examiner*—Michael J. Carone
*Attorney, Agent, or Firm*—Scully, Scott, Murphy & Presser

[57] ABSTRACT

An airborne body possessing an over-caliber sized guidance mechanism having control surfaces which are retracted into the structure of the airborne body and arrested therein at their end surfaces through a securing arrangement so as to be released for outward extension into the operative position of the guidance mechanism in dependence upon an acceleration in the firing or launching direction. The airborne body is equipped with a pusher rod or ram which concurrently engages into all control surfaces and which is axially displaceable relative to the structure of the airborne body, and which upon a reduction in the acceleration of the airborne body in the launching direction, is disengaged from the control surfaces.

7 Claims, 3 Drawing Sheets

AIRBORNE BODY

BACKGROUND OF THE INVENTION

1. Field of the Invention

The present invention relates to an airborne body possessing an over-caliber sized guidance mechanism having control surfaces which are retracted into the structure of the airborne body and arrested therein at their end surfaces through a securing arrangement so as to be released for outward extension into the operative position of the guidance mechanism in dependence upon an acceleration in the firing or launching direction.

2. Discussion of the Prior Art

An airborne body of the type under consideration herein is known from the disclosure of U.S. Pat. No. 4,728,058, commonly assigned to the assignee of the present application. In that instance, the airborne body with retracted control surfaces is inserted into a front-loader weapon barrel or launch tube, so as to be fired therefrom in the manner of mortar ammunition. With the initiation of the firing acceleration, occasioned through the triggering of the propellent charge, the securing pins which are individually arranged in the control surfaces will unlatch, so that the control surfaces can swing outwardly up to contact against the inner casing surface of the launch tube or barrel, and subsequent to exiting from the tube can swing completely outwardly into the radially extended operative position.

However, the invention concurrently relates to correspondingly equipped airborne bodies, which are launched from a launching device as rockets through the intermediary of a firing or launching propulsion mechanism; and especially pertains to airborne bodies which are fired from a rifled weapon barrel or launch tube; however, with a reduced spin, for example, as is illustrated with respect to flight end-phase guided artillery ammunition as disclosed in WEHRTECHNIK, Vol. 9/1986, page 47 lower right. In such instances, due to reasons of ensuring operational dependability and safety in launching of the airborne body, it is not permissible that the control surfaces which have already been released from the securing arrangement can still support themselves in the starting or launching arrangement; in effect, within the weapon barrel, and since the outward pivoting into the operative position at the beginning of free-flight can evidence irregularities, there is encountered the quite considerable danger that from the foregoing this can result in launching malfunctions and, as a consequence, errors in delivery; in effect, this can produce a diminished effect of the airborne body in the envisioned target object.

SUMMARY OF THE INVENTION

Accordingly, in recognition of these conditions, it is an object of the present invention to equip an airborne body of the type under consideration herein with such a type of securing arrangement, whereby the release for allowing the extension of the control surfaces into the over-caliber sized operative position is effected concurrently and only after completion of the launching or firing procedure, without necessitating any operationally-critical and space-consuming auxiliary devices for this purpose.

The foregoing object is inventively attained in that the airborne body of the type considered herein is equipped with a pusher rod or ram which concurrently engages into all control surfaces and which is axially displaceable relative to the structure of the airborne body, and which upon a reduction in the acceleration of the airborne body in the launching direction, is disengaged from the control surfaces.

In accordance with the foregoing, there is provided a unitary securing arrangement which acts concurrently for all control surfaces, which responds in dependence upon the ending of the launching acceleration and thereby only after exiting the launching device or the firing barrel, and then releases all control surfaces concurrently for their radial extension into the operative position.

Thus, such an arrangement has generally become known from the disclosure of German Laid-Open Patent Appln. No. 34 32 614 for the support or carrying wings of an airborne body, to permit a cup-shaped retainer element to concurrently engage into all extendable or swing wings; however, in that instance, for the release of the wings there is required a space consuming expansion device for pressurized gas which must be separately triggered, so that it is not possible to preclude any malfunction caused by an erroneous activation of the gas generator. In contrast therewith, an inventively equipped securing arrangement can be constructed in an essentially much smaller size, and due to functional coupling to the completion of the launching or firing acceleration, can be implemented significantly more operationally reliable in its action.

Pursuant to the inventive object, the control surfaces of the airborne body are simultaneously secured for both storage and transport, and during the axial launching acceleration will be reliably prevented from being released, inasmuch as the forces resulting therefrom will only support the securing engagement. The launching acceleration is employed merely for the shearing off of an arresting or latching pin in order to place the securing arrangement into operational readiness, whereupon the unlatching or release of the control surfaces is effected at a sufficient reduction in the launching acceleration; in effect, will reliably take place during free-flight. Even for the outward driving of the control surfaces from their retracted position into the operative position of the guidance mechanism is there no need for any constructive auxiliary measures when, through only the suitable arrangement of the axes for the outward extension axis, provision is made that the remaining axial thrust, eventually supported by centrifugal forces, will move the unlatched control surfaces into the radially spread apart position. However, the securing arrangement, which is then without any function for the extended control surfaces, can concurrently possess guiding functions for the still retracted support or carrying wings, as long as these still form-fittingly engage in corresponding guide grooves; so that also with respect to this partial function, the inventive securing arrangement represents an operational and spatially optimum solution.

BRIEF DESCRIPTION OF THE DRAWINGS

Additional alternatives and modifications, as well as further features and advantages of the invention can now be readily ascertained from the following detailed description of generally schematically represented exemplary embodiments thereof, taken in conjunction with the accompanying drawings; in which.

DETAILED DESCRIPTION

Figure 1:
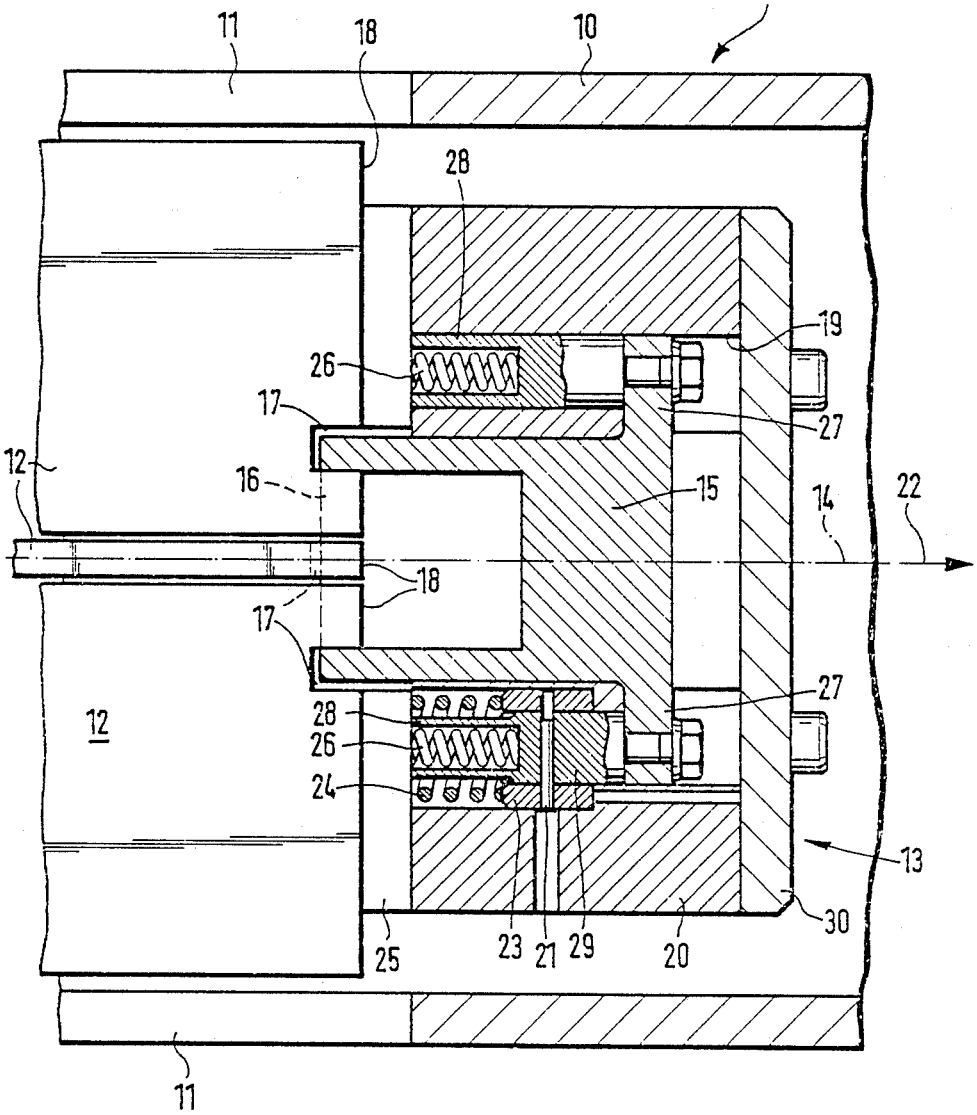
FIG. 1 illustrates an axial longitudinal section through the structure of the airborne body with a fragmentary representation of the engagement of the securing arrangement in the end surface of the control surface, shown in its latched position.

An airborne body 9, in the tail end region of its structure 10, is equipped with slots 11 extending in planes which intersect at right angles, through which the rearwardly articulated (not shown in the drawing) control surfaces 12 are at least partially retracted into the interior of the structure 10 of the airborne body during storage and transport, as well as for the launching or firing from a weapon barrel or launch tube, so as to reduce the effective outer diameter of the overall arrangement relative to the outwardly extended operative position of the control surfaces 12. Serving for the retention of the control surfaces 12 in this retracted position is a securing arrangement 13, which is essentially constituted of a pusher rod 15 or ram guided for displacement in the direction of the axis 14 of the airborne body structure, from which a crown or head portion 16 engages in an axially-parallel manner into recesses 17 in the free end edges 18 of the control surfaces 12. As illustrated, this crown 16 can be cup-shaped; in effect, fastened surroundingly as a hollow-cylindrical wall to the pusher rod 15; or there can be provided individual claws projecting rearwardly from the pusher rod 15 for engagement into the recesses 17 (not shown in the drawing).

The longitudinal guidance for the rod 15 with its crown 16 is effected along the inner wall 19 of the housing 20 of the securing arrangement 13. In the secured position illustrated in FIG. 1, with the engagement of the crown 16 of the pusher rod into the control surfaces 12, the pusher rod 15 is arrested through a shear pin 21, such that the secured engagement in the control surfaces 12 will also be reliably maintained under conditions of handling.

Figure 2:
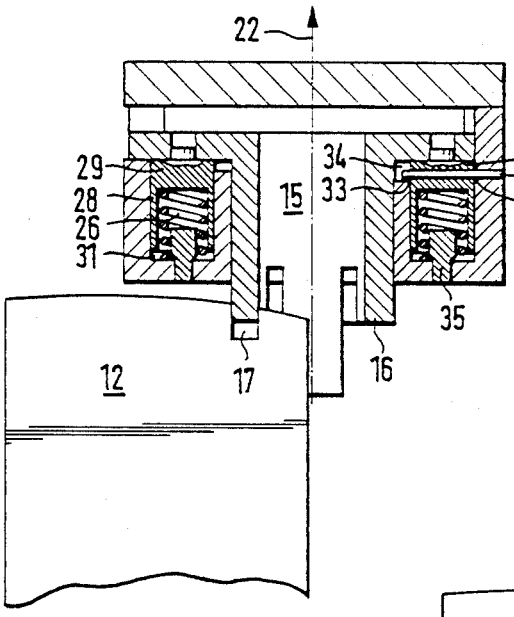
FIG. 2 illustrates a fragmentary portion from the representation of FIG. 1, showing a modified embodiment of the securing arrangement with respect to the latching thereof.
Figure 3:
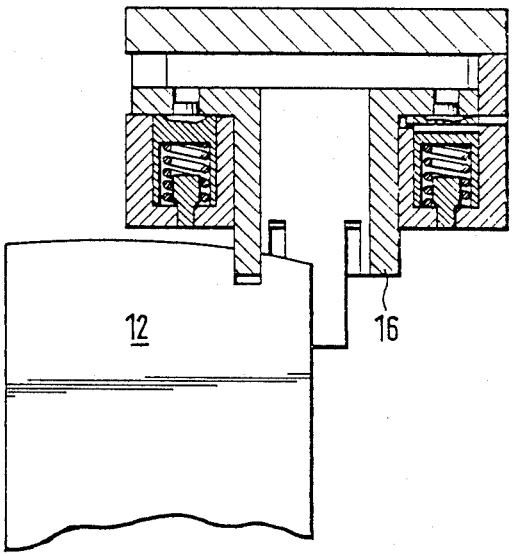
FIG. 3 illustrates the securing arrangement of FIG. 2 in a released condition.
Figure 4:
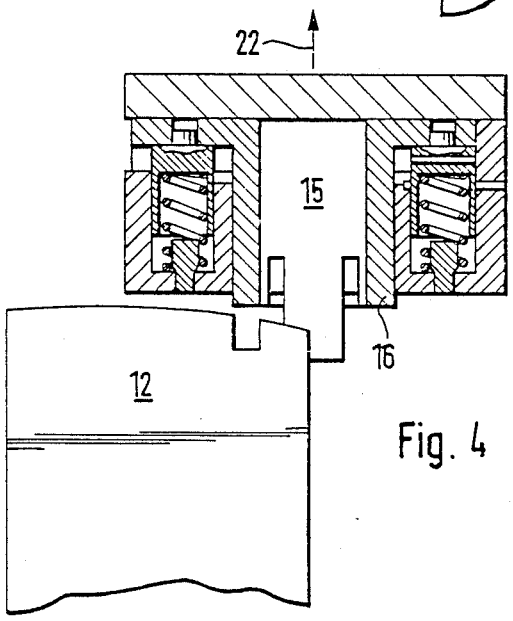
FIG. 4 illustrates the securing arrangement of either FIGS. 2 or 3 in the released position for the control surface.

At the launching of the airborne body 9; for example, through firing from a weapon barrel by means of propellent charge in the launching direction 22, the pin 21 is sheared off by an inertial mass, in the exemplary case of FIG. 1 constituted of a separate sleeve 23; in the case of FIGS. 2 to FIG. 4 by the crowned pusher rod 15 itself. Relative to the structure 10 of the airborne body, this sleeve 23 is also displaced opposite the launching direction 22 with the shearing off of the pin 21. A damping spring 25 reduces the impact or rebounding momentum of this inertial shearing sleeve 23 against the mounting flange 24 for the installation of the securing arrangement 13 in the structure 10 of the airborne body.

Due to its inertia, the securing pusher rod 15 also tends towards to a relative displacement opposite the launching direction 22. However, it is hindered in that regard; in essence, restricted in its movement through the compressed length of cylindrical food or spacer springs 26 which are clamped between the mounting flange 25 and the flanges 27 on the pusher rod. For arresting any movement, instead thereof or in addition thereto, there can also be provided a supporting sleeve 28 which is correspondingly dimensioned in its length, and which is surrounded by the applicable feed spring 26. In the illustrated exemplary embodiment of FIG. 1, a support sleeve 28 serves concurrently as an internal guide for the cylindrical damping spring 24. Through the restriction in the possibility of movement for the pusher rod 15, and thereby its crown 16, opposite the launching direction 22, there is ensured at a correspondingly deeper dimensioning of the recesses 17 in the end surfaces, that no supporting forces are assumed in the longitudinal direction of the control surfaces 12, and must be caught by the further rearwardly located pivot axes; in effect, the control surfaces 12 are not subjected to any additional mechanical stresses due to their inertia during firing.

Hinge pins 29 are located in series with the feed springs 26, which pins can be integrally constructed with the support sleeves 28. A variation in the axial length of the hinge pins 29 facilitates a greater constructive freedom in the design of the spring characteristics of the applicable feed spring 26. This design is implemented in such a manner that the crowned pusher rod 15 is displaced under the action of the spring forces in the launching direction 22, when the launching or firing acceleration (for example, due to the burned-out launching propulsion mechanism or due to exiting from a weapon barrel) has fallen below a mission-typical value. Because of the displacement of the crown 16 in the launching direction 22; in essence, out of the recesses 17 in the control surfaces, the control surfaces 12 are released. The arrangement of the pivot axes of the latter relative to their centers of gravity (not shown in the drawing) is selected in such a manner that, as necessitated by inertia, there is produced a torque for the outward extension of the control surfaces 12 through the slots 11 out of the structure 10 into the radially extended operative position, in which there is effected a latching into the operative condition (not shown). Turning moments or torques acting on the airborne body 9 which would be detrimental to the mission are hereby not encountered, inasmuch as the securing crown 16, as required by its construction, will concurrently release all four control surfaces.

For the case of a firing of the airborne body 9 from a weapon barrel or launch tube, at a corresponding design in the mass of the crowned pusher rod, there can also be eliminated the feed springs 26. This is because the launching acceleration which is occasioned by the propellent charge in the weapon barrel will break down sudden-like when the tail end of the airborne body 9 exits from the weapon barrel. This breakdown in the launching acceleration; in essence, the delay during the course of the movement in the launching direction 22, leads to a force in the launching direction 22 which acts on the crowned pusher rod 15, and thereby in the effective direction of the feed springs 26, so that these can be eliminated with a suitable force-mass design, even for the release in the securing of the control surface. A restriction in the extent of movement of the crowned pusher rod 15 in the launching and releasing direction 22 is implemented, in the illustrated exemplary embodiment, by means of a housing cover 13 for the securing arrangement 13.

In the modified embodiment pursuant to FIGS. 2 through 4, the open axial depth of the recesses 17 in the control surface is selected so large, that shearing of the latching pin 21 can be carried out through a rearward displacement of the crowned pusher rod 15, without the end surface of the crown 16 being seated on the control surfaces 2. In order to facilitate this shearing movement of the crowned pusher rod 15, in the illustrated exemplary embodiment also that of the support sleeve 28 including the hinge pins 29 carried along therewith, in the arrested or latched position (FIG. 2), the respective spring 26 is not compressed to contact between its windings, and behind the opening in the support sleeve 28 there is provided a corresponding axial free space 31, which then serves as a limit for the shearing movement (FIG. 3).

In the interest of obtaining higher necessary shearing forces, two shearing locations 32, 33 are provided for the arresting pin 21, in which the pin 21 is completely struck through by the support sleeve 28 or its hinge pins 29 into an oppositely-located contact space 34.

In order to avoid any misalignments, in the embodiment pursuant to FIGS. 2 though 4 there are finally provided axial guide pins 35 which are fixed to the housing, and which through engagement into hollow-cylindrical inner space of the feed springs 26, prevent any buckling of the springs 26 caused by the effects of forces due to high acceleration.

From the released position of this securing arrangement 13 due to the sheared pin 21, pursuant to FIG. 3 there is then effected the transition into the released position for the control surfaces pursuant to FIG. 4 subsequent to the reduction in the launching acceleration, in the instance of the presence of feed springs 26 supported thereby is the spring biasing force acting in the launching direction 22. With the contact of the crowned pusher rod 15 against the housing cover 30, the control surfaces 12 are thus released for the lateral outward pivoting through the slots 11 in the structure 10 (FIG. 1).

Figure 5:
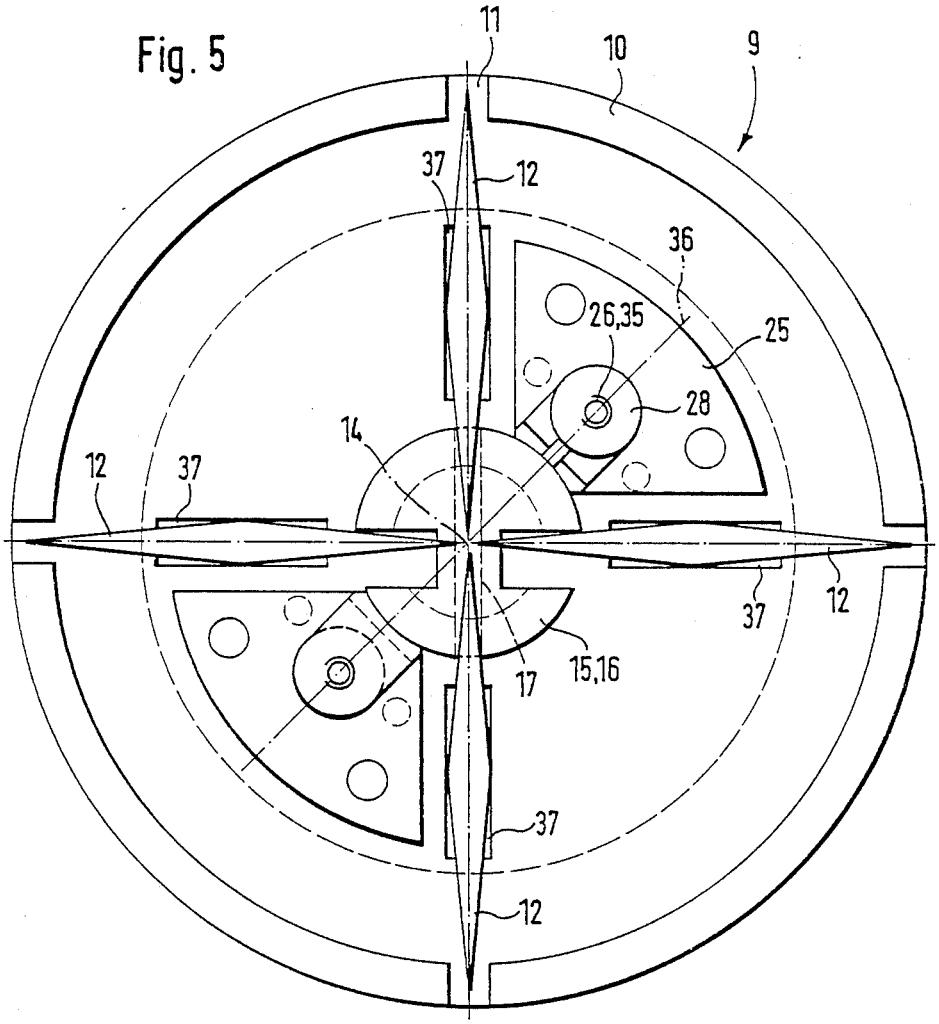
FIG. 5 illustrates a transverse cross-section through airborne body with the securing arrangement pursuant to the above figures being arranged azimuthally offset relative to the retracted control surfaces.

For simplification of an overview in the representation, in FIGS. 1 through 4 the two feed springs 26 are illustrated in the longitudinal sectional plane of two diametrically oppositely located control surfaces 12. In order to save space, however, the practical implementation is expediently carried out pursuant to FIG. 5 through a butterfly wing-shaped configuration of the mounting flange 25, whose central axis 36 is located somewhat in the angle bisector between two azimuthally adjacent control surfaces 12.

In contrast with the exemplary representation in the drawing, it is not necessary that the feed springs 26 act as compression springs in the launching direction 22. When, because of functional or constructive reasons, the installation space is restricted in the cross-sectional direction, instead of the two diametrically oppositely located feed springs 26 as illustrated in the drawing, there can also be provided a single tension spring, which is located, for example, in the longitudinal axis 14 of the airborne body on the side of the pusher rod 15 opposite the crown 16 (fastened to the housing cover 30 or extending therethrough) and contacts directly, or through a linkage, in the direction 22 against the pusher rod 15.

What is claimed is:

1. Airborne body with over-caliber size guidance mechanism, including control surfaces retracted into the airborne body; a securing arrangement latching the control surfaces at the end surfaces thereof into said airborne body for releasing said control surface in dependence upon acceleration of said airborne body in the launching direction for effectuating the extension of said control surfaces into the operative position of the guidance mechanism; a pusher rod which concurrently engages into all control surfaces and which is axially displaceable in the launching direction relative to the structure of the airborne body, said pusher rod disengaging from said control surfaces into the launching direction upon a reduction in the acceleration of the airborne body; a shear pin latching said pusher rod to a housing in said airborne body; and a shearing mass for shearing aid pin which is displaceable relative to said pusher rod opposite the launching direction.

2. An airborne body as claimed in claim 1, including at least one power element contacting said pusher rod in the launching direction.

3. An airborne body as claimed in claim 2, wherein the power element comprises a feed spring; and a support sleeve for said pusher rod guiding aid spring.

4. An airborne body as claimed in claim 1, wherein said shearing mass comprises a shearing sleeve.

5. An airborne body as claimed in claim 4, wherein a damping spring element is arranged in the path of movement of the shearing sleeve.

6. An airborne body as claimed in claim 1, wherein the pusher rod comprises a shearing mass for shearing the shear pin through displacement opposite the launching direction.

7. An airborne body as claimed in claim 1, wherein the retracted control surfaces and said securing arrangement overlap at least partly in the direction of the longitudinal axis of the projectile, with engagement of the securing arrangement between two azimuthally adjacent retracted control surfaces.

* * * * *